US010914546B1

(12) United States Patent
Casto, Jr. et al.

(10) Patent No.: US 10,914,546 B1
(45) Date of Patent: Feb. 9, 2021

(54) PNEUMATIC BALL LAUNCHER FOR FACILITATING LAUNCHING OF A BALL

(71) Applicants: Arlos Franklin Casto, Jr., Marietta, OH (US); William James Alatis, Centreville, VA (US)

(72) Inventors: Arlos Franklin Casto, Jr., Marietta, OH (US); William James Alatis, Centreville, VA (US)

( * ) Notice: Subject to any disclaimer, the term of this patent is extended or adjusted under 35 U.S.C. 154(b) by 0 days.

(21) Appl. No.: 16/872,092

(22) Filed: May 11, 2020

Related U.S. Application Data

(60) Provisional application No. 62/936,150, filed on Nov. 15, 2019.

(51) Int. Cl.
*F41B 11/723* (2013.01)
*F41B 11/62* (2013.01)
*F41B 11/80* (2013.01)

(52) U.S. Cl.
CPC ..... *F41B 11/723* (2013.01); *F41B 11/62* (2013.01); *F41B 11/80* (2013.01)

(58) Field of Classification Search
CPC ..... F41B 11/723; F41B 11/62; F41B 11/80; A63B 67/02
USPC ..... 124/73
See application file for complete search history.

(56) References Cited

U.S. PATENT DOCUMENTS 1,783,053 A * 11/1930 Baden-Powell ..... F41B 3/04 124/6
2,338,762 A * 1/1944 Groth ..... F41A 33/04 434/16
3,262,441 A * 7/1966 Senne ..... A01K 81/00 124/22
3,521,616 A * 7/1970 Chang ..... F41B 11/51 124/67
3,554,482 A * 1/1971 Dunkin ..... F16K 31/003 251/74
3,584,614 A * 6/1971 Horvath ..... A63B 69/409 124/56
3,610,222 A * 10/1971 Hartman ..... F41J 9/26 124/73
3,685,828 A * 8/1972 Getgey ..... F41B 1/00 273/356
3,911,888 A * 10/1975 Horvath ..... A63B 69/409 124/56
3,990,426 A * 11/1976 Stokes ..... A63B 69/409 124/56
4,027,646 A * 6/1977 Sweeton ..... A63B 69/409 124/56

(Continued)

*Primary Examiner* — John Cooper

(57) ABSTRACT

Disclosed herein is a pneumatic ball launcher for facilitating launching of a ball. Accordingly, the pneumatic ball launcher may include an air chamber, a fill assembly, an air blast valve, a trigger assembly, and a parabolic curved barrel. Further, the air chamber may be configured for receiving at least one gas. Further, the air chamber may be configured for storing the at least one gas at a gas pressure based on the receiving. Further, the fill assembly may be fluidly coupled with the air chamber. Further, the fill assembly facilitates transferring of the at least one gas into the air chamber. Further, the air blast valve may be fluidly coupled to the air chamber. Further, the trigger assembly may be operationally coupled with the air blast valve. Further, the parabolic curved barrel may be coupled to the air blast valve using a locking breech assembly.

15 Claims, 17 Drawing Sheets

(56) References Cited

U.S. PATENT DOCUMENTS 4,054,120 A * 10/1977 Foley ..... A63F 9/0208 124/62
4,207,857 A * 6/1980 Balka, Jr. ..... A63B 69/409 124/44.7
4,250,862 A * 2/1981 Speer ..... A63B 69/409 124/56
4,345,578 A * 8/1982 Speer ..... A63B 69/40 124/56
4,632,088 A * 12/1986 Bruce ..... A63B 69/406 124/6
4,774,786 A * 10/1988 Zaremba ..... A01M 3/027 124/18
4,995,374 A * 2/1991 Black ..... A01K 15/025 124/32
5,332,222 A 7/1994 Perry
5,660,160 A * 8/1997 Prescott, Jr. ..... F41B 11/68 124/70
5,819,715 A * 10/1998 Haneda ..... F41B 3/00 124/6
5,832,909 A * 11/1998 Grant ..... A63B 69/406 124/6
5,924,932 A 7/1999 Taylor
6,183,372 B1 2/2001 Anderegg, Jr.
6,324,779 B1 * 12/2001 Tippmann, Jr. ..... F41A 21/00 124/81
6,805,111 B2 * 10/2004 Tippnnann, Jr. ..... F41A 21/00 124/74
7,063,623 B2 6/2006 Wengert
8,900,065 B2 12/2014 Taylor
2002/0100361 A1 * 8/2002 Russell ..... F41A 1/00 89/14.5
2004/0200465 A1 * 10/2004 Forti ..... F41B 1/00 124/62
2005/0066953 A1 * 3/2005 Zouboulakis ..... F41A 21/482 124/73
2009/0064980 A1 * 3/2009 Yeh ..... F41B 11/62 124/71
2011/0226227 A1 * 9/2011 Douglas ..... F41B 11/57 124/77
2012/0272941 A1 * 11/2012 Hu ..... F41A 21/10 124/83
2015/0027426 A1 * 1/2015 Isabelle ..... F41B 11/52 124/49
2018/0058800 A1 * 3/2018 Sandgren ..... F41A 9/69

* cited by examiner

PNEUMATIC BALL LAUNCHER FOR FACILITATING LAUNCHING OF A BALL

The current application claims a priority to the U.S. Provisional Patent application Ser. No. 62/936,150 filed on Nov. 15, 2019.

FIELD OF THE INVENTION

Generally, the present disclosure relates to the field of amusement devices: games. More specifically, the present disclosure relates to a pneumatic ball launcher for facilitating launching of a ball.

BACKGROUND

The game of golf has evolved utilizing clubs which must be held correctly, and swung precisely along a sweeping path, into contact with a ball, impelling/propelling the ball on the course, towards the green. Various types of clubs use different angles on the club faces, to be able to create different trajectories with the ball, corresponding for use at different distances from the green. While golf is very popular, there are many people that lack the skill or strength, or otherwise possess a disability that prevents them from swinging a club.

There are even more people that are younger, frail, or perhaps even elderly people who would otherwise enjoy the sport of golf but are not capable of physically swinging a club hard enough, accurately enough, or repeat this swinging motion enough times to participate in the sport.

Therefore, there is a need for an improved pneumatic ball launcher for facilitating launching of a ball that may overcome one or more of the above-mentioned problems and/or limitations.

BRIEF SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a pneumatic ball launcher for facilitating launching of a ball, in accordance with some embodiments. Accordingly, the pneumatic ball launcher may include an air chamber, a fill assembly, an air blast valve, a trigger assembly, and a parabolic curved barrel. Further, the air chamber may be configured for receiving at least one gas. Further, the air chamber may be configured for storing the at least one gas at a gas pressure based on the receiving. Further, the fill assembly may be fluidly coupled with the air chamber. Further, the fill assembly facilitates transferring of the at least one gas into the air chamber. Further, the air blast valve may be fluidly coupled to the air chamber. Further, the air blast valve may be configured for expelling the at least one gas from the air chamber. Further, the trigger assembly may be operationally coupled with the air blast valve. Further, the trigger assembly may be configured for receiving at least one action. Further, the trigger assembly may be configured for controlling the air blast valve based on the at least one action. Further, the parabolic curved barrel may be coupled to the air blast valve using a locking breech assembly. Further, the parabolic curved barrel may be configured for receiving a ball. Further, the expelling of the at least one gas from the air chamber may be routed to the parabolic curved barrel for facilitating launching of the ball. Further, the parabolic curved barrel may be configured for inducing at least one backspin to the ball. Further, the at least one backspin may be associated with at least one backspin rate.

Further disclosed herein is a pneumatic ball launcher for facilitating launching of a ball, in accordance with some embodiments. Accordingly, the pneumatic ball launcher may include an air chamber, a fill assembly, an air blast valve, a trigger assembly, and a parabolic curved barrel. Further, the air chamber may be configured for receiving at least one gas. Further, the air chamber may be configured for storing the at least one gas at a gas pressure based on the receiving. Further, the fill assembly may be fluidly coupled with the air chamber. Further, the fill assembly facilitates transferring of the at least one gas into the air chamber. Further, the air blast valve may be fluidly coupled to the air chamber. Further, the air blast valve may be configured for expelling the at least one gas from the air chamber. Further, the trigger assembly may be operationally coupled with the air blast valve. Further, the trigger assembly may be configured for receiving at least one action. Further, the trigger assembly may be configured for controlling the air blast valve based on the at least one action. Further, the parabolic curved barrel may be coupled to the air blast valve using a locking breech assembly. Further, the parabolic curved barrel may be configured for receiving a ball. Further, the expelling of the at least one gas from the air chamber may be routed to the parabolic curved barrel for facilitating launching of the ball. Further, the parabolic curved barrel may be configured for inducing at least one backspin to the ball. Further, the at least one backspin may be associated with at least one backspin rate. Further, the parabolic curved barrel may include an interior parabolic curved surface. Further, the interior parabolic curved surface may include at least one protrusion. Further, the at least one protrusion may be configured for imparting the at least one backspin of the at least one backspin rate to the ball moving along the interior parabolic curved surface for the launching.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
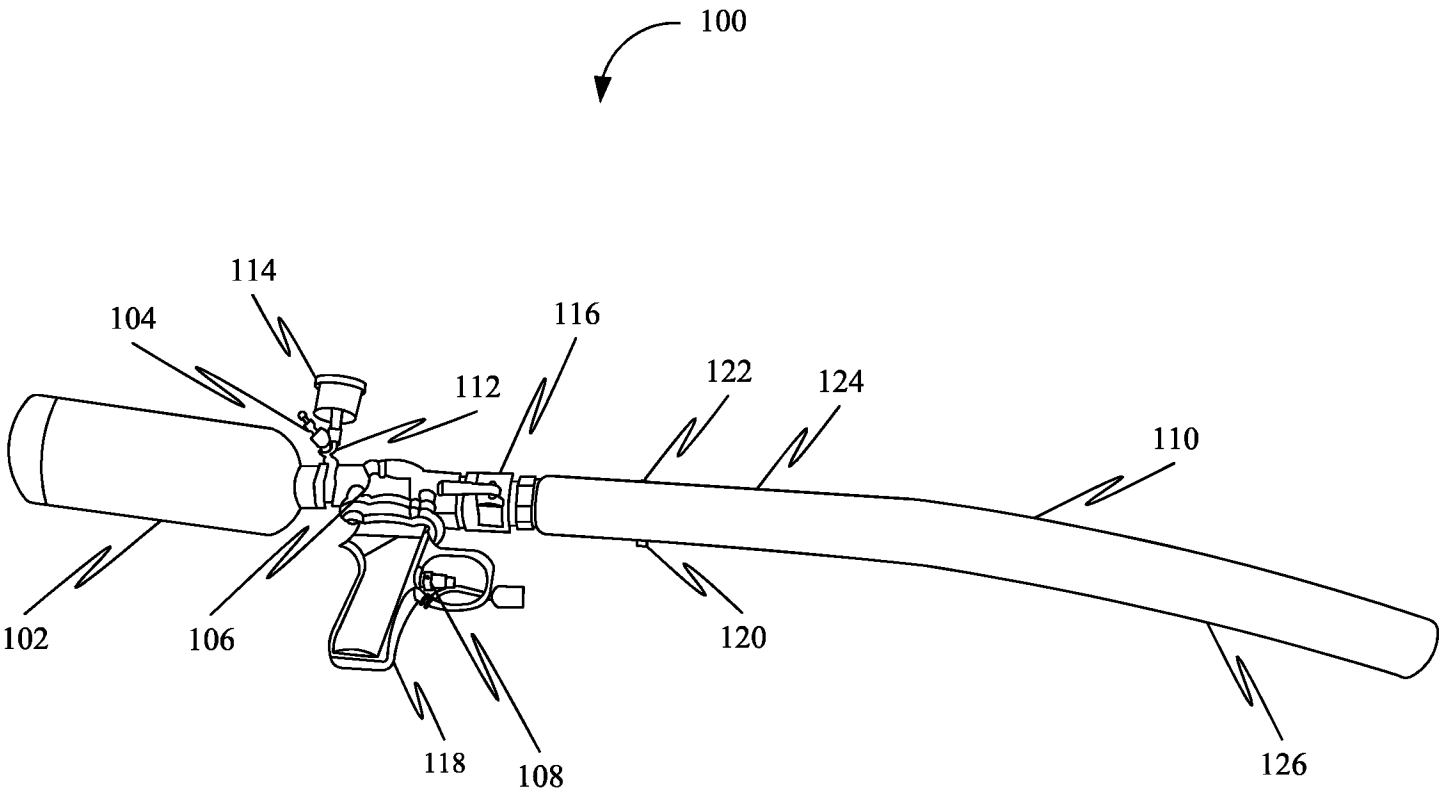
FIG. 1 is a front perspective view of a pneumatic ball launcher for facilitating launching of a ball, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a pneumatic ball launcher for facilitating launching of a ball, embodiments of the present disclosure are not limited to use only in this context.

Overview:

The present disclosure describes a pneumatic ball launcher for facilitating launching of a ball. Further, the present disclosure may describe a hand-held, swing-less, pneumatic, golf club replacement with more accurate ball flights and more realistic golf ball landings at all desired distances. Therefore, allowing a person to not swing a club and/or swing a club less throughout the game while providing increased safety, and more accurate ball flights and more realistic golf ball landings at all desired distances.

Further, the present disclosure is capable of accurately driving/launching/impelling a golf ball by a controllable distance on a golf course without the necessity of swinging the club, while more accurately reproducing conventional golf ball behaviors, such as loft, flight time, and backspin. These enhance the ability to "stick," or bounce less, upon landing and have more limited rollout (thus staying on the intended fairway or green after landing), Another object of the present disclosure is to create a swingless, pneumatic, golf club replacement that provides play similar to a conventional golf club in appearance, while being lightweight, hand-held, and still fit easily into a conventional golf bag. Another object of the present disclosure is to create a swingless, pneumatic, golf club replacement of durable and modular construction that is capable of withstanding rough handling and use, and its modular design allows quick replacement of damaged, lost, or stolen parts.

This creates both a swingless and a "swingless" aspect of gameplay while retaining conventional golf ball behaviors, such as loft, flight time, and backspin, the ability to stick upon landing and have more limited rollout. A ball launching device which reduces or eliminates the need for individuals to swing a golf club, so that more individuals may play golf without needing as much training, strength, or skill as normally required.

Further, the ball launching device may be carried by a player while the player is walking or stowed in the golf bag while riding a golf cart. Further, in some embodiments, the golf ball launcher may have a removable grip, to aid in control, or be configured without the grip. A preferred version of the golf ball launcher uses any standard golf ball that is then launched directly by a measured charge of compressed air down the parabolic curved barrel, down the fairway, towards the green.

The hand-held, swing-less, pneumatic, golf club replacement is suitable for disabled individuals and/or individuals who wish to play a round of golf in a rapid manner without the inconvenience of carrying an entire set of golf clubs and provides a way for unskilled, less skilled, new, or seasoned golfers, or golfers with disabilities or physical handicaps.

An all-new replacement for golf clubs, to be used for playing golf, and without swinging a club. Further, the golf club is replaced by a new and improved launcher, using inexpensive compressed air or gasses, at a relatively low, safe pressure. The sudden release of the compressed air or gasses directly propels the ball down a specially curved barrel, to launch the ball in a more accurate fashion, with realistic landings similar to being played off a golf clubface. This desirable performance within the game of golf is otherwise impossible with a launched, fired, or conventionally-propelled ball. Notably, the spin generated by the unique parabolic curve results in a ball path that is much more predictable—and thus safer—than any other conventional means of impelling/propelling a golf ball.

The club requires only a source of compressed air or gasses provided by economical, existing portable sources either refillable carbon dioxide canisters as used in paintball or common rechargeable, portable tire inflators. This club replacement, along with its accompanying compressed gas source, is portable and can be utilized anywhere that a conventional club may be used, with the added benefit of not requiring the strength, control, or training that a conventional golf club requires.

The pneumatic club is always ready for use. The user inserts their golf ball, adds air pressure to the desired pressure that corresponds to the desired range, aims downrange with various elevations or inclines rather like an archer, by sighting along the top, along the side or through the sights, and depresses the trigger.

The resulting launch impels/propels the ball along the barrel, and the parabolic curve of the barrel constantly deflects the ball. The resulting friction of the ball, combined with the prepared barrel surface, induces backspin on the ball, generating Magnus effect forces that simulate the climb, the glide and the drop of the golf ball struck by a conventional club.

The backspin eliminates the erratic flight characteristics of "the knuckleball effect," as well as preventing hooking and slicing. Also, the ability to aim the device, and even anchor it while aiming, requires less strength and skill than hitting a ball to produce desirable results with a club. This resulting ease of use allows people with less strength, stature, or physical ability to enjoy the sport, and extends the sport to individuals that may have disabilities which prevent them from playing/enjoying the sport.

In addition, many casual players don't have much time or resources available to learn the game. The aforementioned ease of attaining highly-desirable results also gives new golfers the ability to successfully join friends and family on the courses with relatively little initial practice, yet without slowing down the speed of group play. This is very desirable from a golf-course business perspective, which favors short intervals between tee times, and from the perspective of more experienced golfers who can become impatient with new golfers.

The ball launching device may facilitate playing a game of golf with modified rules or a handicap system, on an established for-profit or municipal golf course. (1) alone, (2) or along with other golfers also using our device or a different device or devices which we agree to allow, (3) along with another golfer or golfers using official rules or rules as negotiated at the time of starting the round of play.

In this scenario, the device may facilitate maintaining the ideal of avoiding the delay of play—avoiding delaying other golfers in a group, and by playing within the general schedule (10 minutes per hole) set by the starting tee time of the golf course to avoid inconveniencing other groups of golfers.

FIG. 1 is a front perspective view of a pneumatic ball launcher 100 for facilitating launching of a ball, in accordance with some embodiments. Accordingly, the pneumatic ball launcher 100 may include an air chamber 102, a fill assembly 104, an air blast valve 106, a trigger assembly 108, and a parabolic curved barrel 110.

Further, the air chamber 102 may be configured for receiving at least one gas. Further, the air chamber 102 may be configured for storing the at least one gas at a gas pressure based on the receiving.

Further, the fill assembly 104 may be fluidly coupled with the air chamber 102. Further, the fill assembly 104 facilitates transferring of the at least one gas into the air chamber 102.

Further, the air blast valve 106 may be fluidly coupled to the air chamber 102. Further, the air blast valve 106 may be configured for expelling the at least one gas from the air chamber 102.

Further, the trigger assembly 108 may be operationally coupled with the air blast valve 106. Further, the trigger assembly 108 may be configured for receiving at least one action. Further, the trigger assembly 108 may be configured for controlling the air blast valve 106 based on the at least one action.

Further, the parabolic curved barrel 110 may be coupled to the air blast valve 106 using a locking breech assembly. Further, the parabolic curved barrel 110 may be configured for receiving a ball. Further, the expelling of the at least one gas from the air chamber 102 may be routed to the parabolic curved barrel 110 for facilitating launching of the ball. Further, the parabolic curved barrel 110 may be configured for inducing at least one backspin to the ball. Further, the at least one backspin may be associated with at least one backspin rate.

Further, in some embodiments, the fill assembly 104 may include a safety pop-off mechanism 112 configured for limiting the gas pressure.

Further, in some embodiments, the fill assembly 104 may include a pressure gauge 114 configured for providing a visual indication of the gas pressure.

Further, in some embodiments, the fill assembly 104 may include a rear aiming gauge (not shown) for facilitating aiming of the pneumatic ball launcher 100 for the launching of the ball.

Further, in some embodiments, the locking breech assembly may include a cam lock connector 116. Further, a first part of the cam lock connector 116 may be coupled to a valve end of the air blast valve 106 and a second part of the cam lock connector 116 may be coupled to a barrel end of the parabolic curved barrel 110. Further, the first part and the second part are detachably coupled.

Further, in some embodiments, the air blast valve 106 may include a pilot portion (not shown). Further, the trigger assembly 108 may be configured for operating the piloted portion for facilitating the expelling of the at least one gas.

Further, in some embodiments, the pneumatic ball launcher 100 may include a removable grip assembly 118 configured for controlling the pneumatic ball launcher 100 during the launching.

Further, in some embodiments, the trigger assembly 108 may be disposed on the removable grip assembly 118.

Further, in some embodiments, the pneumatic ball launcher 100 may include at least one device 120 coupled to the parabolic curved barrel 110. Further, the at least one device 120 may be configured for removably securing the ball received in the parabolic curved barrel 110.

Further, in some embodiments, the parabolic curved barrel 110 may include one or more vent openings 122 disposed on the parabolic curved barrel 110. Further, the one or more vent openings 122 may be configured for controlling a volume of the at least one gas used for the launching of the ball.

Figure 3:
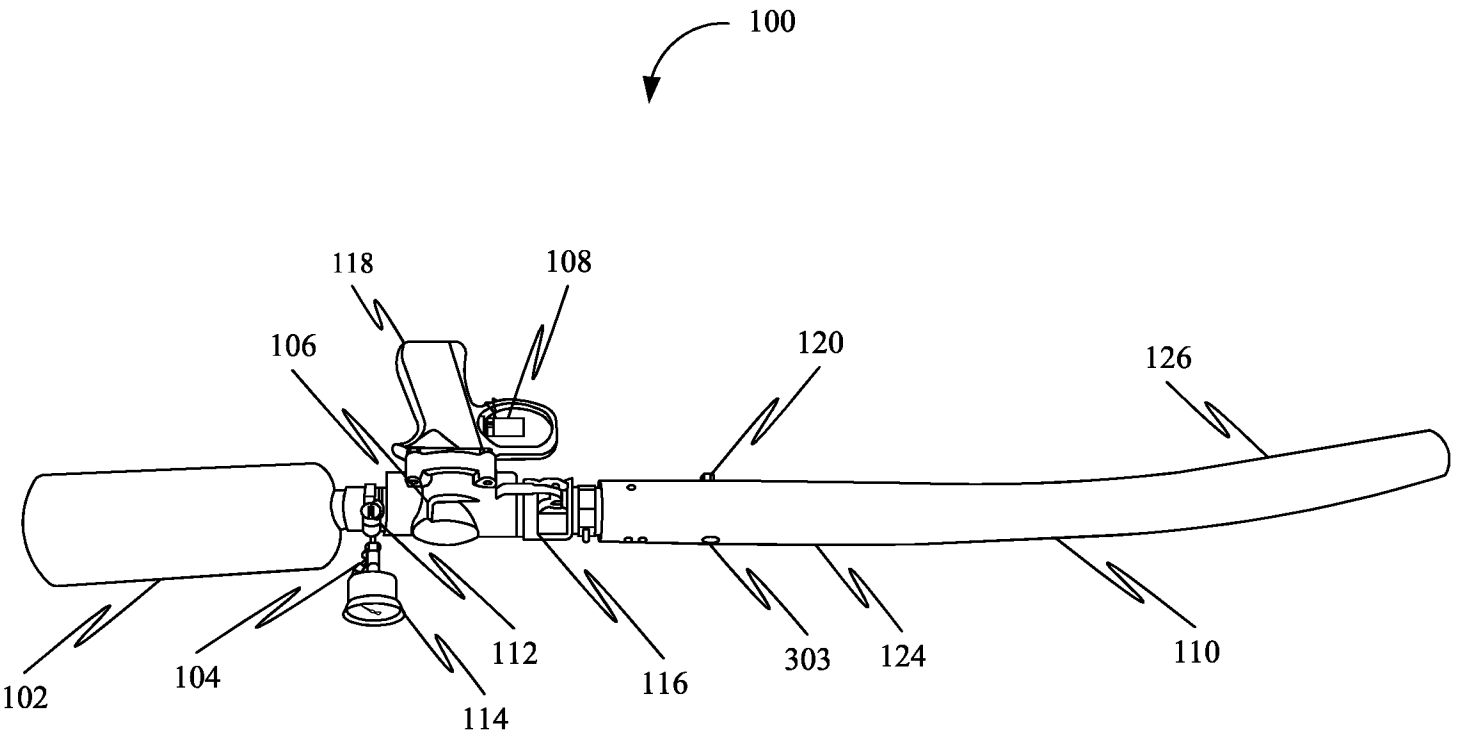
FIG. 3 is a rear top perspective view of the pneumatic ball launcher, in accordance with some embodiments.

Further, in some embodiments, the parabolic curved barrel 110 may include one or more sight openings 303, as shown in FIG. 3, disposed on the parabolic curved barrel 110. Further, the one or more sight openings 303 may be configured for providing a visual of the ball received in the parabolic curved barrel 110.

Further, in some embodiments, the parabolic curved barrel 110 may include a straight section 124 and a curved section 126. Further, the straight section 124 does not induce the at least one backspin to the ball. Further, the curved section 126 induces the at least one backspin to the ball.

Further, in some embodiments, each of the straight section 124 and the curved section 126 may be characterized by a section length. Further, the section length of each of the straight section 124 and the curved section 126 determines the at least one backspin of the ball.

Further, in some embodiments, the curved section 126 may be characterized by a section curvature. Further, the section curvature determines the at least one backspin rate of the at least one backspin.

Further, in some embodiments, the parabolic curved barrel 110 may be characterized by a parabolic curve. Further, the parabolic curve facilitates the inducing of the at least one backspin of the at least one backspin rate to the ball.

Further, in some embodiments, the parabolic curved barrel 110 may be detachably coupled to the air blast valve 106 using the locking breech assembly.

Further, in some embodiments, the parabolic curved barrel 110 may include an interior parabolic curved surface. Further, the interior parabolic curved surface may include at least one protrusion (not shown). Further, the at least one protrusion may be configured for imparting the at least one backspin of the at least one backspin rate to the ball moving along the interior parabolic curved surface for the launching.

Figure 2:
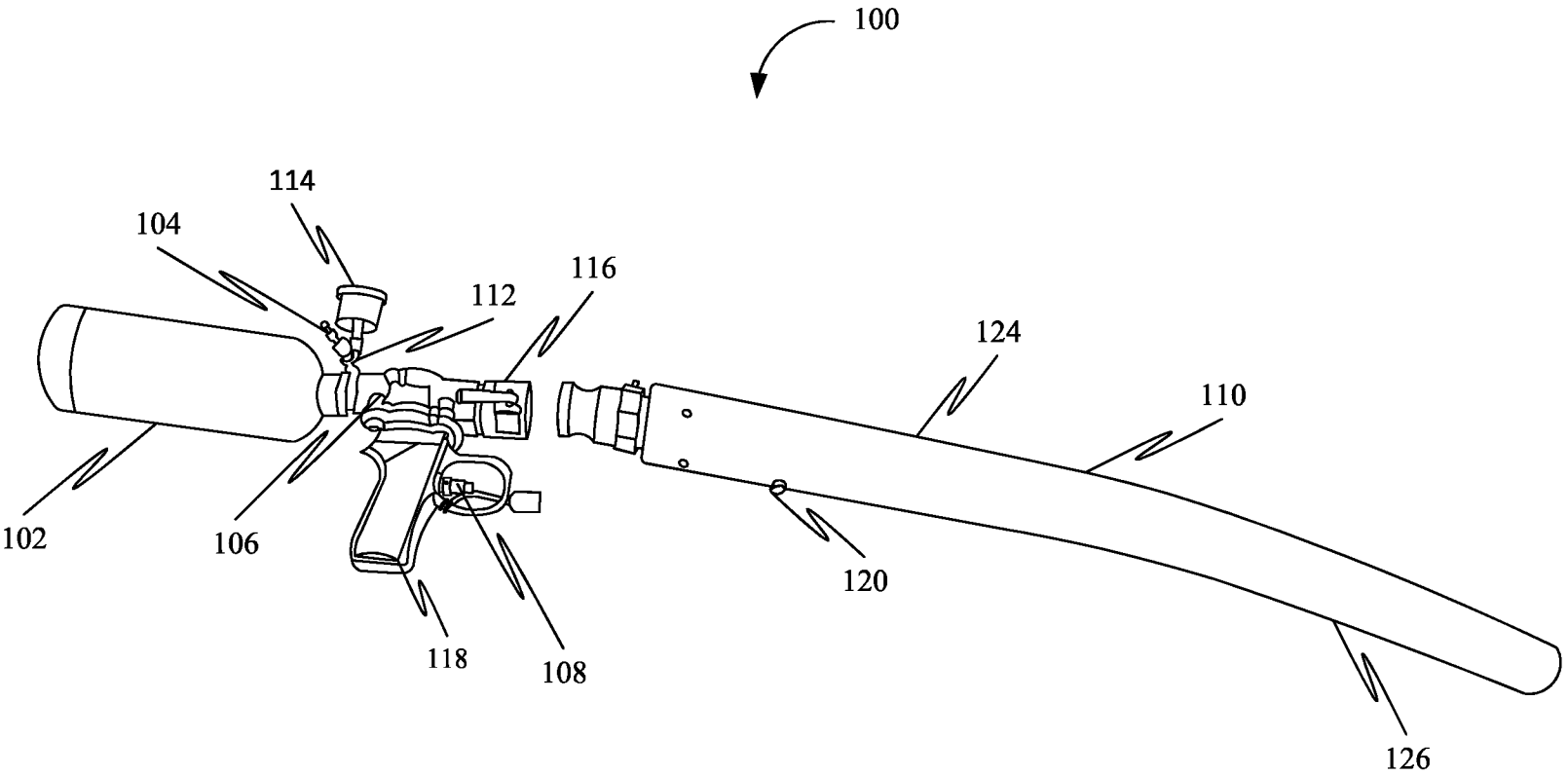
FIG. 2 is a front perspective view of the pneumatic ball launcher with a parabolic curved barrel detached, in accordance with some embodiments.

FIG. 2 is a front perspective view of a pneumatic ball launcher 100 with the parabolic curved barrel 110 detached, in accordance with some embodiments.

FIG. 3 is a rear top perspective view of the pneumatic ball launcher 100, in accordance with some embodiments.

Figure 4:
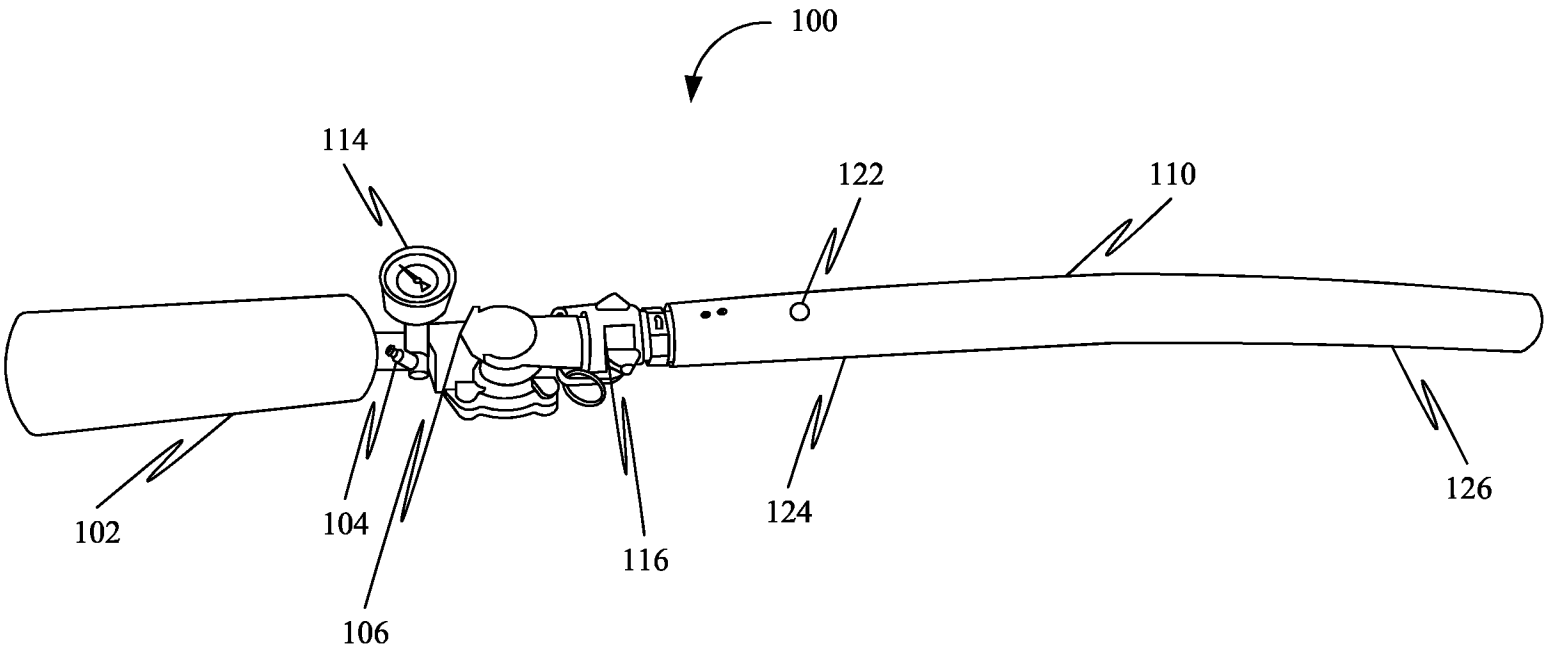
FIG. 4 is a front top perspective view of the pneumatic ball launcher, in accordance with some embodiments.

FIG. 4 is a front top perspective view of the pneumatic ball launcher 100, in accordance with some embodiments.

Figure 5:
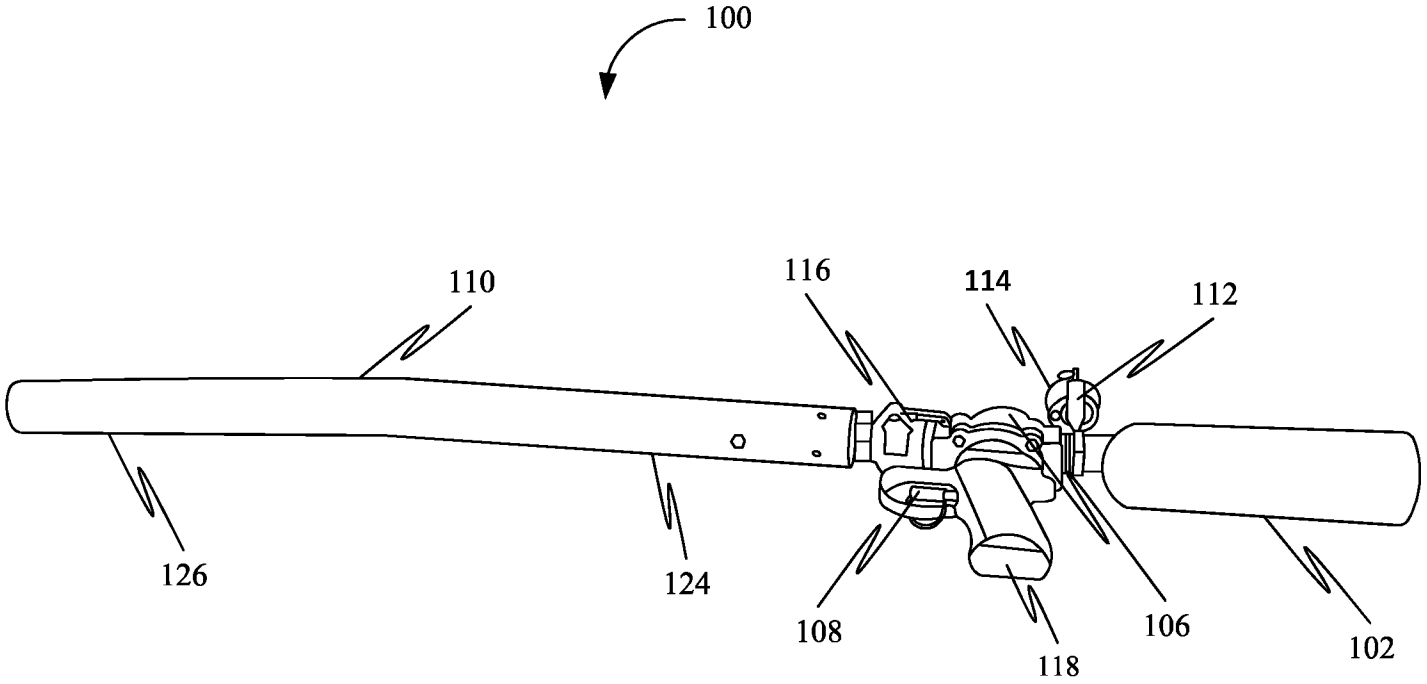
FIG. 5 is a bottom perspective view of the pneumatic ball launcher, in accordance with some embodiments.

FIG. 5 is a bottom perspective view of the pneumatic ball launcher 100, in accordance with some embodiments.

Figure 6:
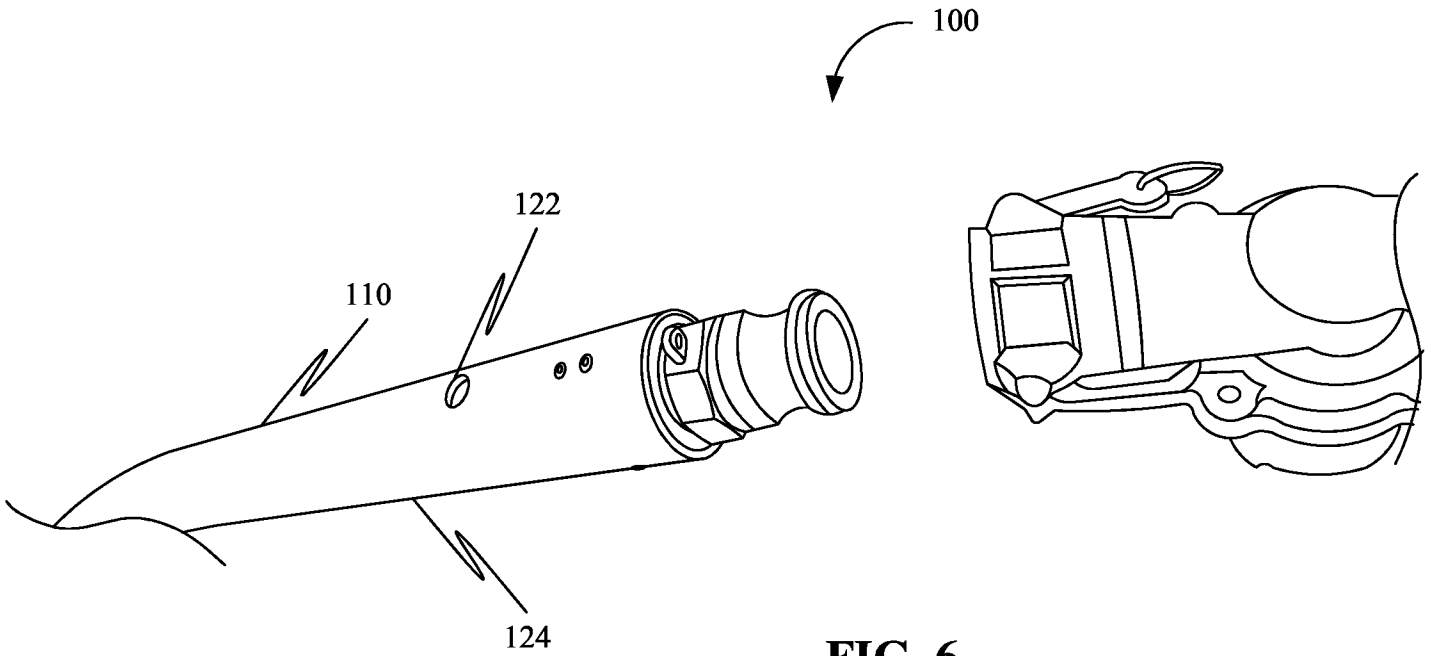
FIG. 6 is a partial view of the pneumatic ball launcher with the parabolic curved barrel detached, in accordance with some embodiments.

FIG. 6 is a partial view of the pneumatic ball launcher 100 with the parabolic curved barrel 110 detached, in accordance with some embodiments.

Figure 7:
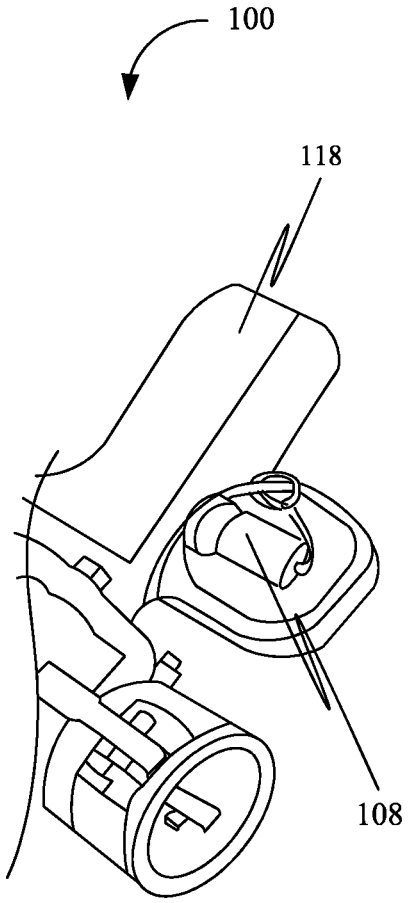
FIG. 7 is a partial close-up view of the pneumatic ball launcher without the parabolic curved barrel, in accordance with some embodiments.

FIG. 7 is a partial close-up view of the pneumatic ball launcher 100 without the parabolic curved barrel 110, in accordance with some embodiments.

Figure 8:
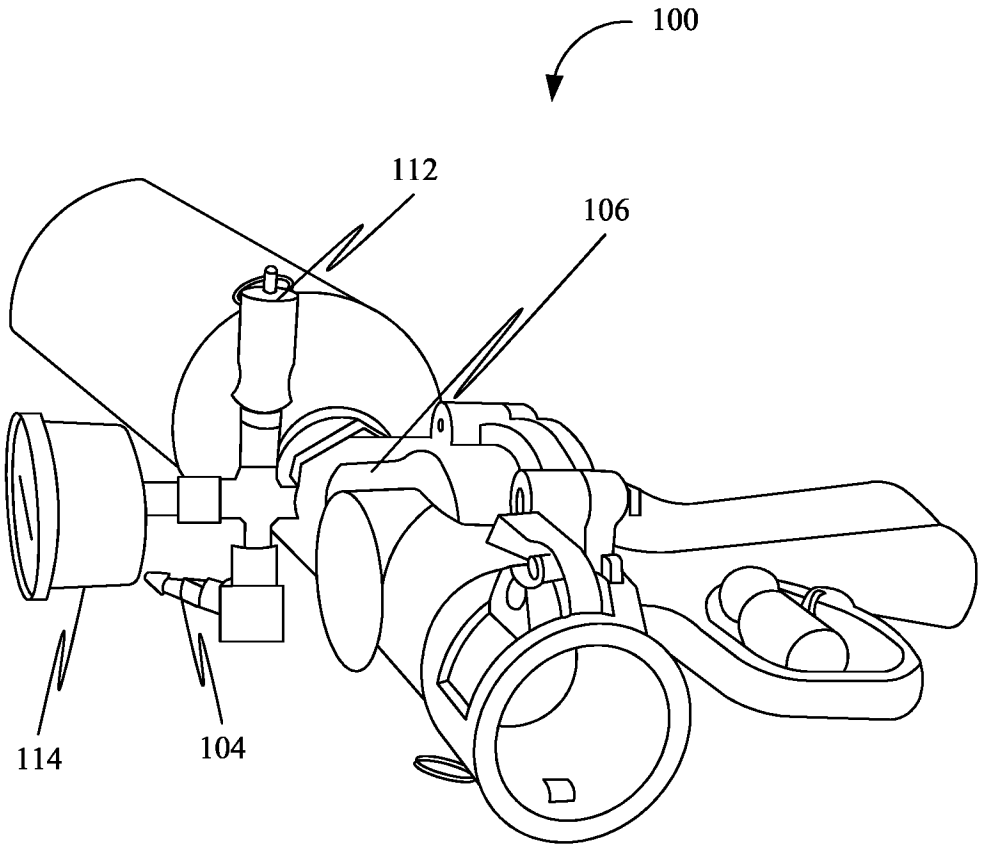
FIG. 8 is a perspective view of the pneumatic ball launcher without the parabolic curved barrel, in accordance with some embodiments.

FIG. 8 is a perspective view of the pneumatic ball launcher 100 without the parabolic curved barrel 110, in accordance with some embodiments.

Figure 9:
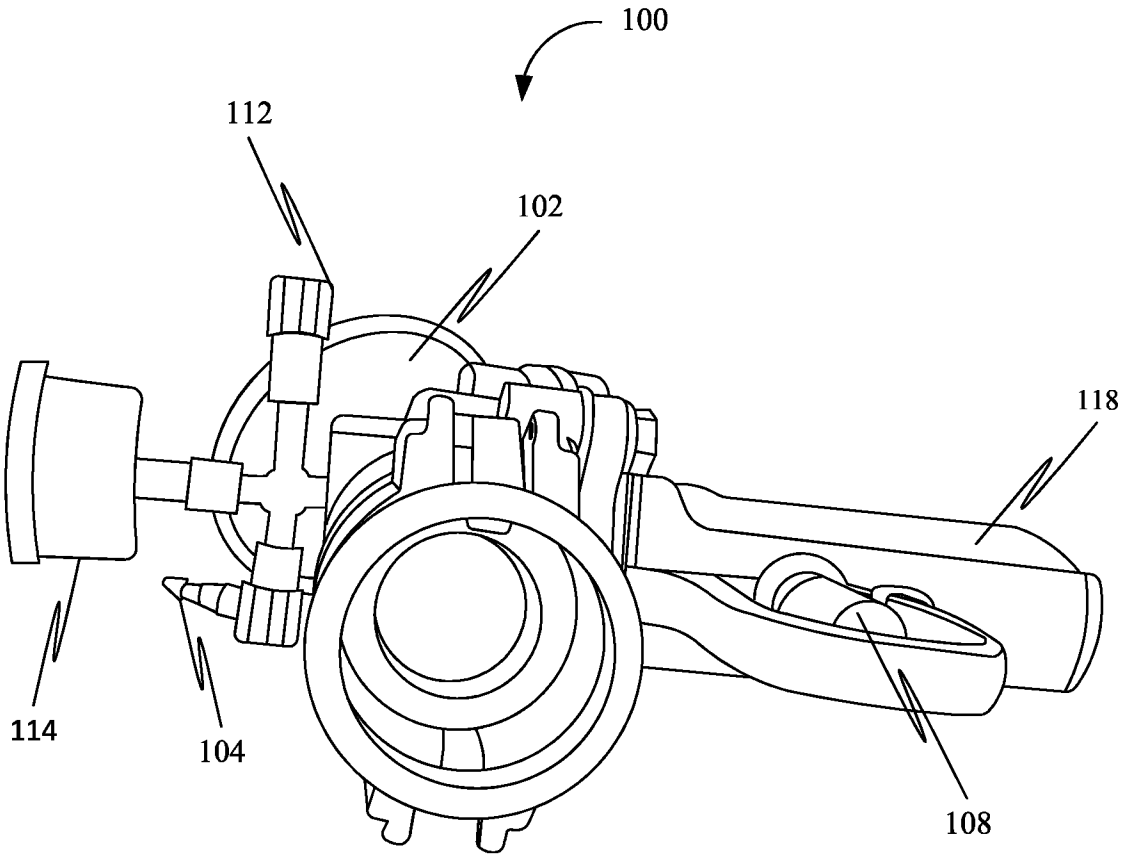
FIG. 9 is a perspective view of the pneumatic ball launcher without the parabolic curved barrel, in accordance with some embodiments.

FIG. 9 is a perspective view of the pneumatic ball launcher 100 without the parabolic curved barrel 110, in accordance with some embodiments.

Figure 10:
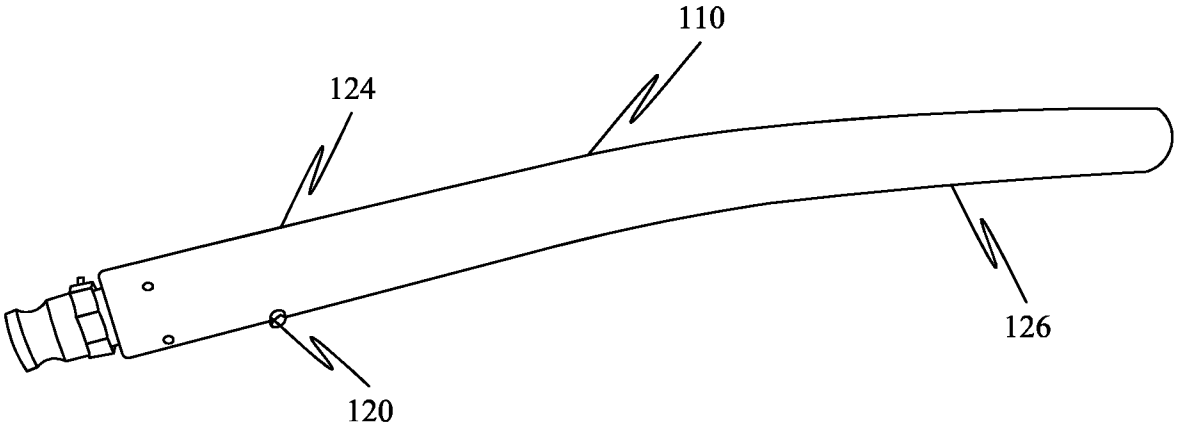
FIG. 10 is a perspective view of the parabolic curved barrel, in accordance with some embodiments.

FIG. 10 is a perspective view of the parabolic curved barrel 110, in accordance with some embodiments.

Figure 11:
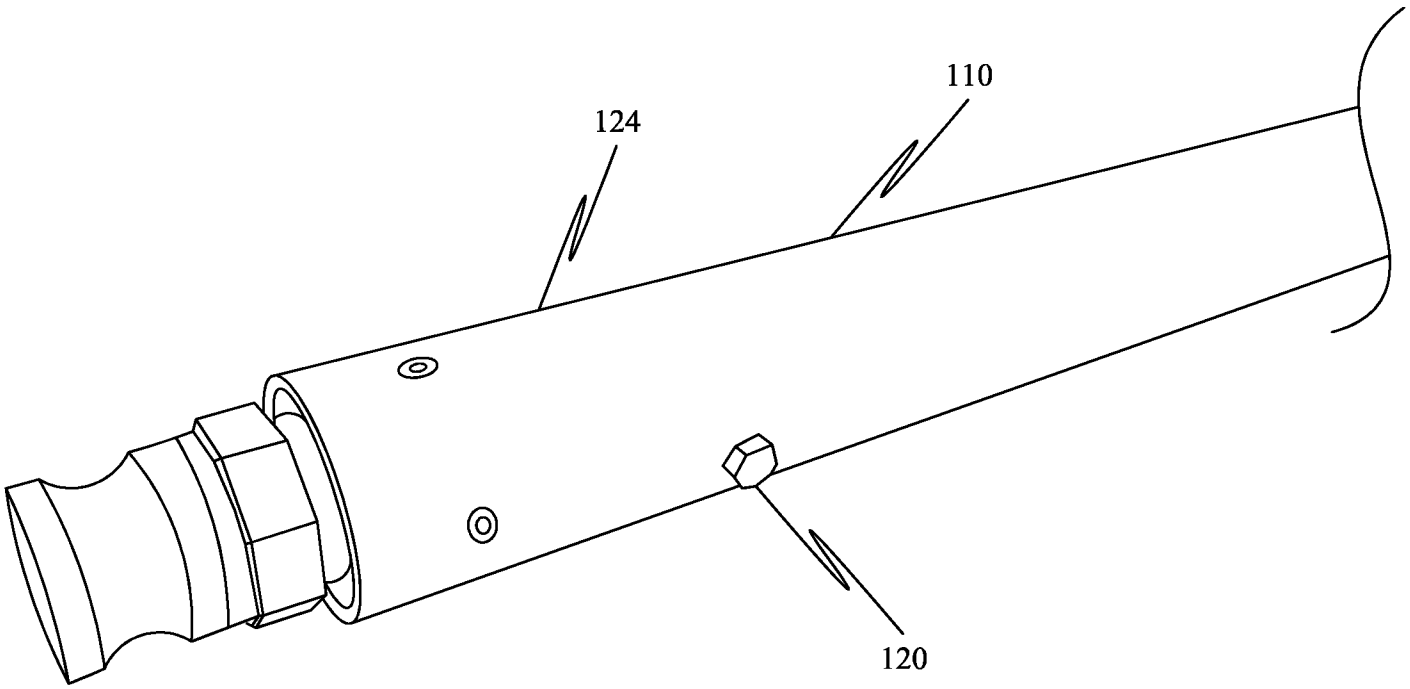
FIG. 11 is a partial view of the parabolic curved barrel, in accordance with some embodiments.

FIG. 11 is a partial view of the parabolic curved barrel 110, in accordance with some embodiments.

Figure 12:
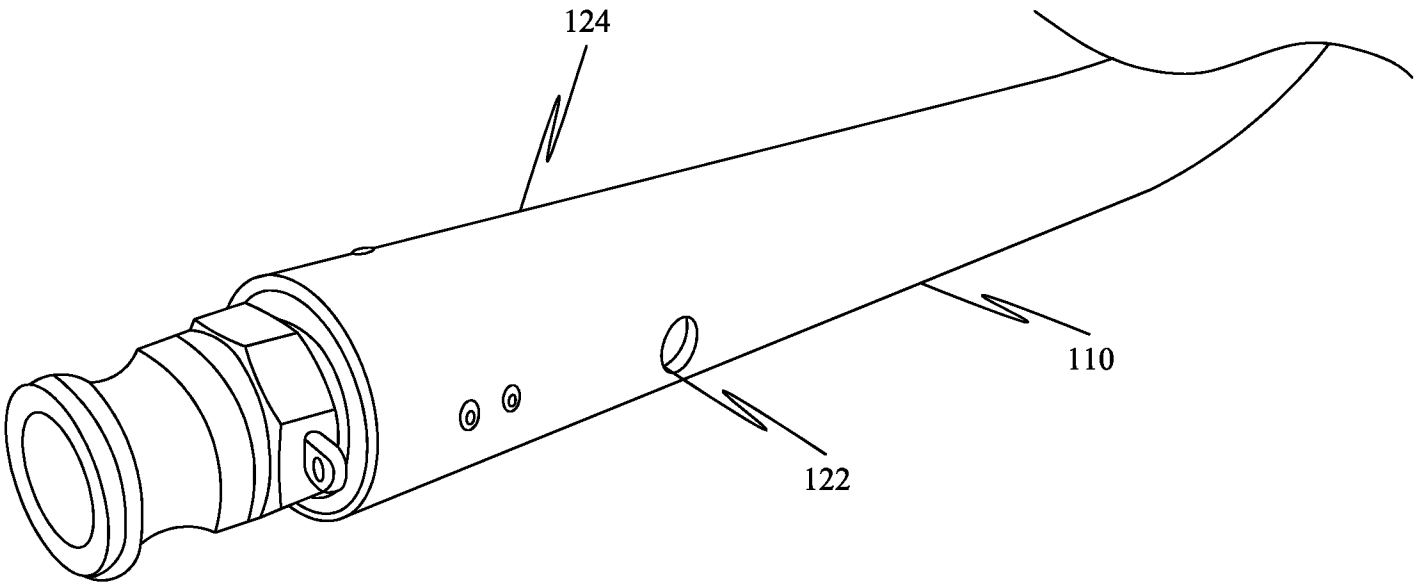
FIG. 12 is a partial view of the parabolic curved barrel, in accordance with some embodiments.

FIG. 12 is a partial view of the parabolic curved barrel 110, in accordance with some embodiments.

Figure 13:
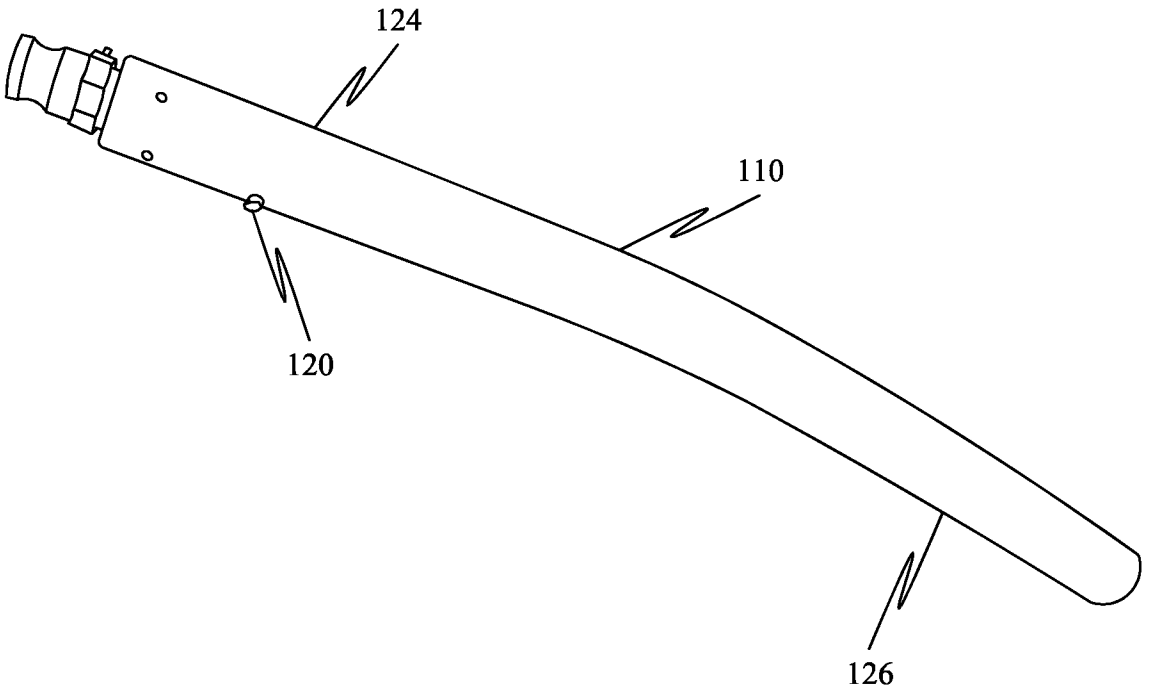
FIG. 13 is a perspective view of the parabolic curved barrel, in accordance with some embodiments.

FIG. 13 is a perspective view of the parabolic curved barrel 110, in accordance with some embodiments.

Figure 14:
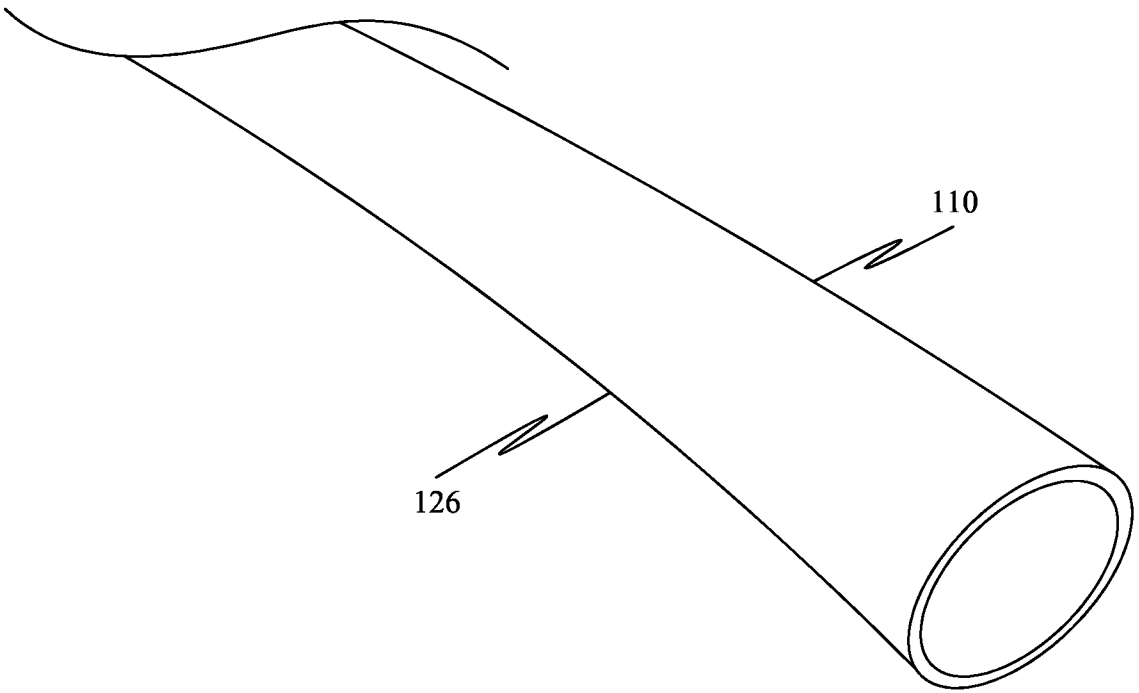
FIG. 14 is a partial view of the parabolic curved barrel, in accordance with some embodiments.

FIG. 14 is a partial view of the parabolic curved barrel 110, in accordance with some embodiments.

Figure 15:
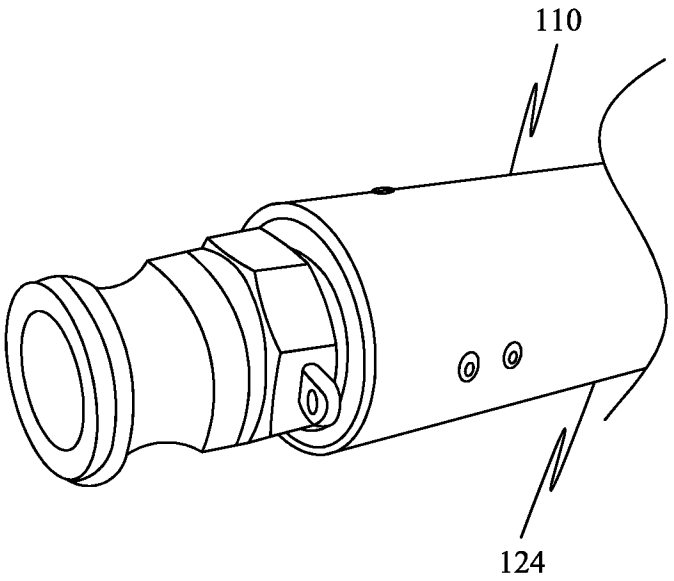
FIG. 15 is a partial view of the parabolic curved barrel, in accordance with some embodiments.

FIG. 15 is a partial view of the parabolic curved barrel 110, in accordance with some embodiments.

Figure 16:
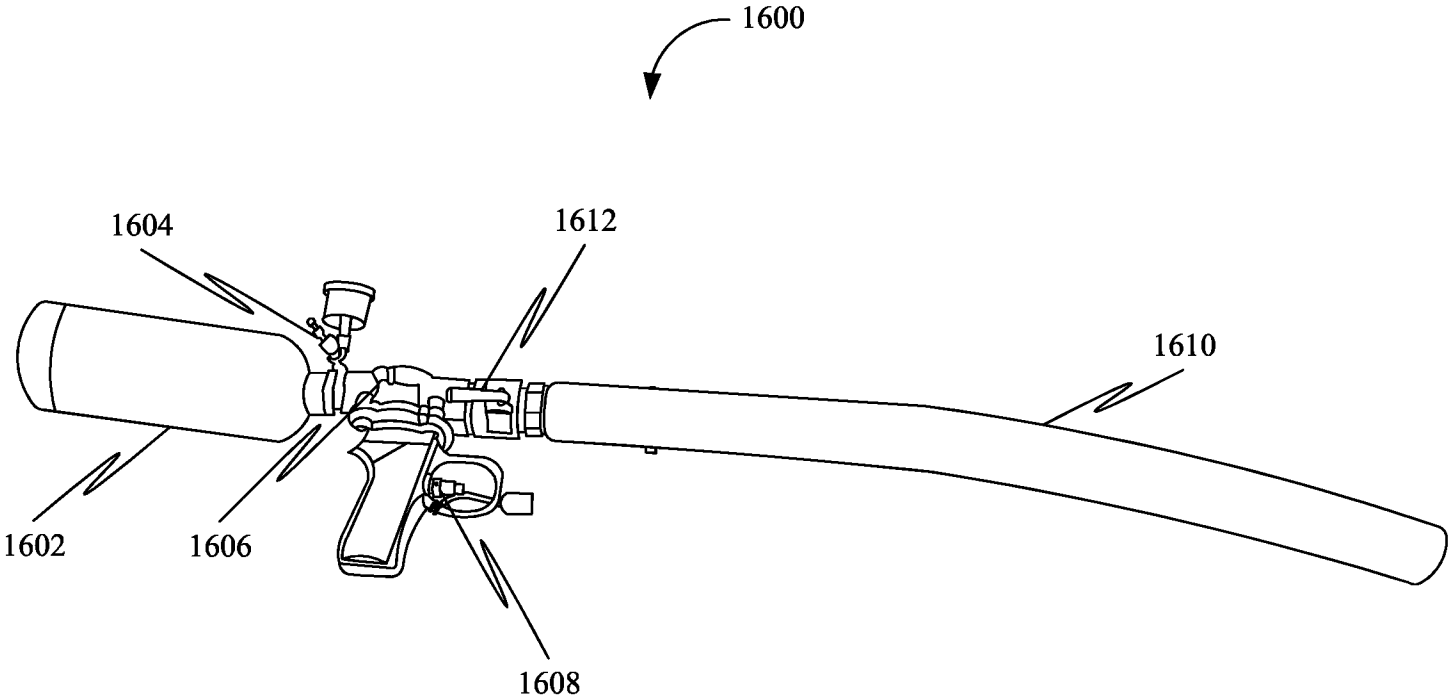
FIG. 16 is a front perspective view of a pneumatic ball launcher for facilitating launching of a ball, in accordance with some embodiments.

FIG. 16 is a front perspective view of a pneumatic ball launcher 1600 for facilitating launching of a ball, in accordance with some embodiments. Accordingly, the pneumatic ball launcher 1600 may include an air chamber 1602, a fill assembly 1604, an air blast valve 1606, a trigger assembly 1608, and a parabolic curved barrel 1610.

Further, the air chamber 1602 may be configured for receiving at least one gas. Further, the air chamber 1602 may be configured for storing the at least one gas at a gas pressure based on the receiving.

Further, the fill assembly 1604 may be fluidly coupled with the air chamber 1602. Further, the fill assembly 1604 facilitates transferring of the at least one gas into the air chamber 1602.

Further, the air blast valve 1606 may be fluidly coupled to the air chamber 1602. Further, the air blast valve 1606 may be configured for expelling the at least one gas from the air chamber 1602.

Further, the trigger assembly 1608 may be operationally coupled with the air blast valve 1606. Further, the trigger assembly 1608 may be configured for receiving at least one action. Further, the trigger assembly 1608 may be configured for controlling the air blast valve 1606 based on the at least one action.

Further, the parabolic curved barrel 1610 may be coupled to the air blast valve 1606 using a locking breech assembly. Further, the parabolic curved barrel 1610 may be configured for receiving a ball. Further, the expelling of the at least one gas from the air chamber 1602 may be routed to the parabolic curved barrel 1610 for facilitating the launching of the ball. Further, the parabolic curved barrel 1610 may be configured for inducing at least one backspin to the ball. Further, the at least one backspin may be associated with at least one backspin rate. Further, the parabolic curved barrel 1610 may include an interior parabolic curved surface. Further, the interior parabolic curved surface may include at least one protrusion. Further, the at least one protrusion may be configured for imparting the at least one backspin of the at least one backspin rate to the ball moving along the interior parabolic curved surface for the launching.

Further, in some embodiments, the locking breech assembly may include a cam lock connector 1612. Further, a first part of the cam lock connector 1612 may be coupled to a valve end of the air blast valve 1606 and a second part of the cam lock connector 1612 may be coupled to a barrel end of the parabolic curved barrel 1610. Further, the first part and the second part are detachably coupled.

Further, in some embodiments, the parabolic curved barrel 1610 may be detachably coupled to the air blast valve 1606 using the locking breech assembly.

Figure 17:
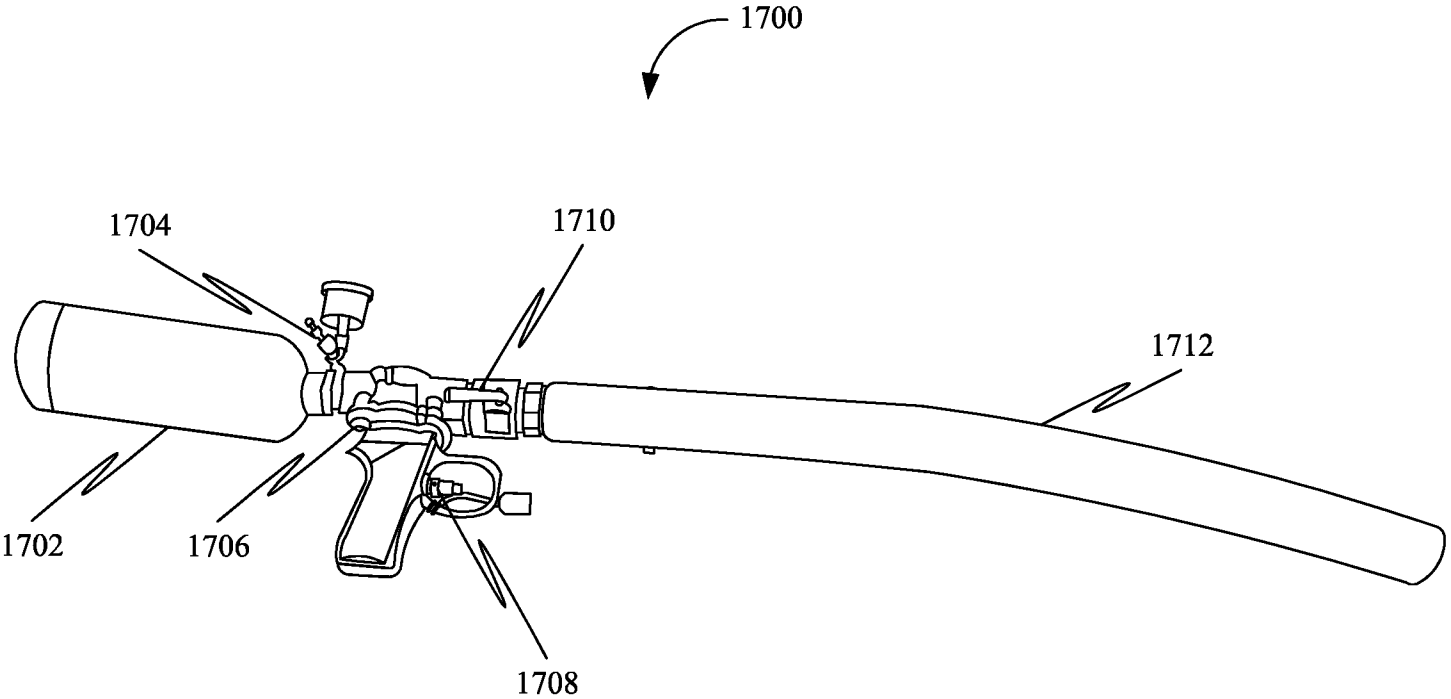
FIG. 17 is a front perspective view of a pneumatic ball launcher for facilitating launching of a ball, in accordance with some embodiments.

FIG. 17 is a front perspective view of a pneumatic ball launcher 1700 for facilitating launching of a ball, in accordance with some embodiments. Accordingly, the pneumatic ball launcher 1700 may include an air chamber 1702, a fill/gauge/safety pop off assembly 1704, an air blast valve 1706, a trigger assembly 1708, a locking breech assembly 1710, and a parabolic curved barrel 1712.

Further, the air chamber 1702 may be shatterproof and unbreakable, even with rough handling, and even while pressurized. Further, the air chamber 1702 may be manufactured from, but not limited to, aluminum, steel, stainless steel, carbon fiber, or other pressure rated material.

Further, the fill/gauge/safety pop off assembly 1704 may include a foster, a tire type Schrader, or other style of fill nipple, and a durable vibration resistant pressure gauge including, but not limited to, a liquid-filled, an air-filled, or a digital, a certified safety pop off, etc. that may be matched to the operating pressure, and not exceeding the designed working pressure of the air chamber 1702. Further, in some embodiments, the gauge may provide the rear aiming point as well as a visual indication of chamber pressure.

Further, the air blast valve 1706 may include a valve such as, but not limited to, a diaphragm valve, a poppet valve, a barrel sealing piston valve, a chamber sealing valve, etc. with air or hydraulic operated pilot portion.

Further, the trigger assembly 1708 may facilitate the launch by operating the piloted portion of the valve. Further, the trigger assembly 1708 may include a component such as, but not limited to, a push-button bleed valve, a ball valve, a hydraulic acting air switch, a normally closed air valve, or any combination of air, hydraulic, diaphragm or other switching type valves. Further, in some embodiments, a manually operated, push-button air bleed valve capable of a Valve Flow Coefficient (Cv) of more than 0.5 may be desired. Further, the trigger assembly 1708 may be placed in an optional, removable, replaceable grip assembly, allowing for more control, as well as the removal of the grip assembly for storage, transport, or where the pneumatic ball launcher 1700 may resemble a gun that may be illegal or frowned upon.

Further, the locking breech assembly 1710 may include a component such as, but not limited to a cam-locking, a twist locking or a threaded barrel coupling, etc. which may be indexed and locked into position without a tool. Further, in some embodiments, the cam lock connections may be used to allow fast-changing and indexing of the different barrels.

Further, the parabolic curved barrel 1712 or set of parabolic curved barrels may induce a varying rate of backspin to a ball. Further, the amount to backspin may be variable and unlike any other method or attempt of inducing backspin, the parabolic curved barrel 1712 may allow the pneumatic ball launcher 1700 to be capable of imparting a rate of backspin similar to the driver or club and may be replaced for any given shot or launch. Further, depending on the orientation of the parabolic curved barrel 1712 and of the air pressure used, the rates of rotation may be controlled from anywhere between 2,500 RPM, like a driver would create, up to 9,000 RPM, similar to nine iron. Further, in some embodiments, different parabolic curved barrels, with different degrees of a parabolic curve may allow the ball a backspin to be as low as zero, to backspin speed in excess of 10,000 RPM.

Further, a standard golf-ball may be loaded into the parabolic curved barrel 1712 of the pneumatic ball launcher 1700, charged to the desired pressure with carbon dioxide (CO2), compressed air from the air chamber 1702, or a portable inflator to produce the desired distance of launch. Further, the parabolic curved barrel 1712 may be lifted to a firing position, pointing downrange, away from the body or any onlookers and towards the safe direction of the desired destination. Further, the parabolic curved barrel 1712 may be lifted, aiming the shot towards a target area as judged by a user, thereby facilitating the next approach shot to the green. Further, the user may point the muzzle of the parabolic curved barrel 1712 at an elevation and aiming point relative to conditions such as wind and humidity, keeping in mind the strength of the launch and a ball speed determined by the pressure charge, depresses the trigger, launching the ball down the fairway.

Further, the parabolic curved barrel 1712, including its parabolic curve, and interior finish, imparts a controlled level of backspin, causing the backspin of the ball to more closely mimic the rate of backspin induced by being struck by a club. Further, the amount of backspin may allow the ball to land with less bounce, and less roll out referred to as 'stick' by golfers.

Further, the parabolic curved barrel 1712 where the curve may not be an arc, but a parabolic curve, that may allow the pneumatic ball launcher 1700 to impart realistic backspin speeds on the ball, with this backspin of the ball, may more closely mimic the rate of spin induced by being struck by a club. Further, the pneumatic ball launcher 1700 may allow less bounce and roll-out, typically less than 5 yards.

Further, the user may travel along the fairway in the observed direction of his/her ball flight, until the user's ball may be found (or declared lost, as in standard golf rules, and a new ball may be dropped and put in play). Further, the ball may be again picked up and the user may stand behind the furthest point of travel from the previous shot, repeating launches or 'shots' until the ball rests on the green or just off the green, to attempt holing or putting the ball with a conventional club or putter. Further, in order to be carried from hole to hole, the parabolic curved barrel 1712 attached to the pneumatic body slides into an existing stand-up golf bag and the body protrudes above the bag.

Further, the parabolic curved barrel 1712, with the starting point of the parabolic curve may be nearly a straight section allowing balls to be initially launched with no backspin. Further, the backspin induced by the friction of the gradually increasing parabolic curved surface, allowing the balls to launch faster having less backspin and slower backspin rate, mimicking a driver, for a maximum distance up to, including, and beyond 300 yards.

Further, the parabolic curved barrel 1712 may be able to swap out with barrels of more extreme curvature, with a reduced straight section at the starting point of the parabolic curve, allowing the ball to be initially launched with backspin may be induced sooner, and the higher rate of backspin creating more height and loft, as well as improved 'stick', and even rollback.

Further, the parabolic curved barrel 1712 may include one or more openings or holes, for visually confirming if the launcher may be loaded or not.

Further, the parabolic curved barrel 1712 may have one or more opening or holes, to be used to control the total amount of air volume that may be used to impel/propel or launch the ball.

Further, the parabolic curved barrel 1712 may have one or more devices for securing a loaded golf-ball in the parabolic curved barrel 1712, and preventing the parabolic curved barrel 1712 from moving or falling out while the launcher may be handled or aimed. Further, in some embodiments, the pneumatic ball launcher 1700 may be a removable, replaceable, spring-loaded detent, which may be used to positively secure and locate the ball, while also allowing the ball to be launched.

Although the present disclosure has been explained in relation to its preferred embodiment, it is to be understood that many other possible modifications and variations can be made without departing from the spirit and scope of the disclosure.

The following is claimed:

1. A pneumatic ball launcher for facilitating launching of a ball, the pneumatic ball launcher comprising:

an air chamber configured for:

receiving at least one gas; and storing the at least one gas at a gas pressure based on the receiving;

a fill assembly fluidly coupled with the air chamber, wherein the fill assembly facilitates transferring of the at least one gas into the air chamber;

an air blast valve fluidly coupled to the air chamber, wherein the air blast valve is configured for expelling the at least one gas from the air chamber;

a trigger assembly operationally coupled with the air blast valve, wherein the trigger assembly is configured for receiving at least one action, wherein the trigger assembly is configured for controlling the air blast valve based on the at least one action; and a parabolic curved barrel coupled to the air blast valve using a locking breech assembly, wherein the parabolic curved barrel is configured for receiving a ball, wherein the expelling of the at least one gas from the air chamber is routed to the parabolic curved barrel for facilitating launching of the ball, wherein the parabolic curved barrel is configured for inducing a plurality of backspins to the ball, wherein the plurality of backspins are associated with a plurality of backspin rates;

wherein the parabolic curved barrel comprises one or more sight openings disposed on the parabolic curved barrel, wherein the one or more sight openings is configured for providing a visual of the ball received in the parabolic curved barrel;

wherein the parabolic curved barrel comprises a straight section and a curved section, wherein the straight section does not induce the plurality of backspins to the ball, wherein the curved section induces the plurality of backspins to the ball.

2. The pneumatic ball launcher of claim 1, wherein the fill assembly comprises a safety pop-off mechanism configured for limiting the gas pressure.

3. The pneumatic ball launcher of claim 1, wherein the fill assembly comprises a pressure gauge configured for providing a visual indication of the gas pressure.

4. The pneumatic ball launcher of claim 1, wherein the fill assembly comprises a rear aiming gauge for facilitating aiming of the pneumatic ball launcher for the launching of the ball.

5. The pneumatic ball launcher of claim 1, wherein the locking breech assembly comprises a cam lock connector, wherein a first part of the cam lock connector is coupled to a valve end of the air blast valve and a second part of the cam lock connector is coupled to a barrel end of the parabolic curved barrel, wherein the first part and the second part are detachably coupled.

6. The pneumatic ball launcher of claim 1, wherein the air blast valve comprises a pilot portion, wherein the trigger assembly is configured for operating the piloted portion for facilitating the expelling of the at least one gas.

7. The pneumatic ball launcher of claim 1 further comprising a removable grip assembly configured for controlling the pneumatic ball launcher during the launching.

8. The pneumatic ball launcher of claim 7, wherein the trigger assembly is disposed on the removable grip assembly.

9. The pneumatic ball launcher of claim 1 further comprising at least one device coupled to the parabolic curved barrel, wherein the at least one device is configured for removably securing the ball received in the parabolic curved barrel.

10. The pneumatic ball launcher of claim 1, wherein the parabolic curved barrel comprises one or more vent openings disposed on the parabolic curved barrel, wherein the one or more vent openings is configured for controlling a volume of the at least one gas used for the launching of the ball.

11. The pneumatic ball launcher of claim 1, wherein each of the straight section and the curved section is characterized by a section length, wherein the section length of each of the straight section and the curved section determines the plurality of backspins of the ball.

12. The pneumatic ball launcher of claim 1, wherein the curved section is characterized by a section curvature, wherein the section curvature determines the plurality of backspin rates of the at least one backspin.

13. The pneumatic ball launcher of claim 1, wherein the parabolic curved barrel is characterized by a parabolic curve, wherein the parabolic curve facilitates the inducing of the plurality of backspins of the plurality of backspin rates to the ball.

14. The pneumatic ball launcher of claim 1, wherein the parabolic curved barrel is detachably coupled to the air blast valve using the locking breech assembly.

15. The pneumatic ball launcher of claim 1, wherein the parabolic curved barrel comprises an interior parabolic curved surface, wherein the interior parabolic curved surface comprises at least one protrusion, wherein the at least one protrusion is configured for imparting the plurality of backspins of the plurality of backspin rates to the ball moving along the interior parabolic curved surface for the launching.

* * * * *